United States Patent [19]

Uetsuhara

[11] Patent Number: 4,797,645

[45] Date of Patent: Jan. 10, 1989

[54] ELECTROMAGNETIC ACTUATOR

[75] Inventor: Tokio Uetsuhara, Urawa, Japan

[73] Assignee: Mitsubishi Mining & Cement Co., Ltd., Tokyo, Japan

[21] Appl. No.: 794,231

[22] Filed: Oct. 18, 1985

Related U.S. Application Data

[63] Continuation-in-part of Ser. No. 774,610, filed as PCT JP84/00084 on Mar. 5, 1984, published as WO85/04044 on Sep. 12, 1985, abandoned.

[51] Int. Cl.[4] ..... H01F 7/08

[52] U.S. Cl. ..... 335/230; 335/81; 335/84

[58] Field of Search ..... 335/28, 29, 80, 81, 335/84, 85, 229, 230, 234

[56] References Cited

U.S. PATENT DOCUMENTS

| | | | |
|---|---|---|---|
| 3,379,214 | 4/1968 | Weinberg | 335/234 X |
| 4,316,167 | 2/1982 | Koehler | 335/234 X |
| 4,419,643 | 12/1983 | Ojima et al. | 335/234 |
| 4,563,663 | 1/1986 | Niekawa et al. | 335/80 |

FOREIGN PATENT DOCUMENTS

| | | | |
|---|---|---|---|
| 51809 | 9/1981 | Japan | 335/81 |
| 131707 | 5/1983 | Japan | 335/230 |

*Primary Examiner*—George Harris
*Attorney, Agent, or Firm*—Bierman & Muserlian

[57] ABSTRACT

An electromagnetic actuator comprising a magnetic circuit consisting of a stationary element and a movable element which actuator applies mechanical force to a valve rod, piston, electro-switch or the like and operates in a monostable manner with high sensitivity and at high speed and has a compact, simple and hardy structure.

2 Claims, 7 Drawing Sheets

ELECTROMAGNETIC ACTUATOR

PRIOR APPLICATION

This application is a continuation-in-part of U.S. patent application Ser. No. 774,610 filed as PCT JP84/00084 on Mar. 5, 1984, published as W085/04044 on Sept. 12, 1985 now abandoned.

TECHNICAL FIELD

The present invention relates to a device which actuates a binary mechanical displacement or holding by electric power in a monostable manner. More particularly, the present invention relates to an electromagnetic actuator which electromagnetically actuates a binary displacement of mechanical operated devices such as a valve rod, piston, movable element or switch, locking means, or the like in accordance with a minute electric current in a pulse series.

BACKGROUND ART

Conventionally, a holding magnet type electromagnetic actuator has been well known for applying mechanical force to a valve rod, piston or the like.

Referring to FIG. 1, there is shown this holding magnet type electromagnetic actuator which comprises a permanent magnet 2, and a pair of cores 1*a* and 1*b* which are respectively wound around with solenoid coils 3*a* and 3*b*. The permanent magnet 2, cores 1*a*,1*b* and the solenoid coils 3*a* and 3*b* are so arranged as to form a magnetic circuit wherein magnetomotive forces of the electromagnet and the permanent magnet are arranged in series; that is, the magnetomotive force of the solenoid coils 3*a* and 3*b* is generated in the counter direction of the coercive force of the permanent magnet 2 when an electric current is flowed through the solenoid coils 3*a* and 3*b*. According to this arrangement, a contact element 4 can be reversibly held in either state shown in FIG. 1(*a*) or FIG. 1(*b*).

When an electric current is so flowed through the solenoid coil 3*a* under the condition shown in FIG. 1(*a*) as to generate the counter magnetomotive force against the coercive force of the permanent magnet 2, the contact element 4 will be attracted to the another core 1*b* which is connected to the permanent magnet 2 and consists of magnetic material having great coercive force as shown in FIG. 1(*b*). On the other hand, when an electric current is so flowed through the solenoid coil 3*b* in the state of FIG. 1(*b*) as to generate the counter magnetomotive force against the coercive force of the permanent magnet 2, the contact element 4 is returned to the initial state shown in FIG. 1(*a*).

Although this holding type electromagnet has a self-holding capability for the contact element 4 when an electric current is not flowed, it has essentially the following demerits.

(1) This type actuator requires two sets of solenoid coils 3*a* and 3*b* for actuating and returning operations so that the structure will be complicated and the size will be enlarged.

(2) An electric current is so flowed through the solenoid coil 3*a* or 3*b* as to generate the magnetomotive force in the counter direction of the coercive force of the permanent magnet 2 in order to reduce the coercive force so that the required ampere turn will be increased. Accordingly, an electric power of at least 10 W is required to generate the propulsive force of 0.2 kg and stroke of 2 mm.

(3) This type actuator requires three electric wires to control the actuation.

DISCLOSURE OF THE INVENTION

With these demerits in mind, it is the primary object of the present invention to provide an electromagnetic actuator of simple, compact and hardy structure which can so operate at high speed and with high sensitivity as to generate under monostable condition.

Referring to FIG. 6, there is shown a schematic illustration showing principle of the electromagnetic actuators according to the present invention. A movable element 2 made of magnetic material is reciprocally moved in the direction represented by the arrow 2*a* and respect to a stationary element 1 made of magnetic material. Assuming that magnetic flux $\phi$ caused by a permanent magnet 3 is dividingly flowed into magnetic flux $\phi_a$ and $\phi_b$ with neglecting the leakage of the magnetic flux, the magnetic flux $\phi$ can be represented by the following equation.

$$\phi=\phi_a+\phi_b \tag{1}$$

When electric current is flowed through a coil 4 so as to generate magnetic flux $\phi_i$ each magnetic flux is overlapped with the magnetic flux $\phi_i$ through magnetic path shown in the drawing since inner reluctance of the permanent magnet 3 is large. Thus the movable element 2 is applied with force Fe represented by the following equation.

$$\begin{aligned} Fe &= K\{-(\phi_i+\phi_a)^2+(\phi_i-\phi_b)^2\} \\ &= K\{-\phi_a^2+\phi_b^2-2\phi_i\times(\phi_a+\phi_b)\} \end{aligned} \tag{2}$$

wherein; K represents a proportional constant.

FIG. 7 shows a conventional plunger type electromagnetic actuator which applies a force $F_p$ represented by the following equation to a movable element 2.

$$F_p=K\phi_i^2 \tag{3}$$

In this equation, bias force caused by a spring 5 is neglected.

According to these equations (1), (2) and (3), the ratio of forces Fe/Fp generated when the particular current at the same ampere turn is supplied to the self-supporting type (latching type) electromagnetic actuator shown in FIG. 6 and the plunger type shown in FIG. 7 can be represented by the following equation.

$$Fe/Fp=-\phi^2+2\phi(\phi_b-\phi_i)/\phi_1^2 \tag{4}$$

A maintaining force F is represented by the following equation.

$$Fl=\phi_b^2-\phi_a^2 \tag{5}$$

However, when the value of $\phi_i=0$, in other words, the coil 4 is free from electric current, the latching type electromagnetic actuator will maintain the latching state; that is, the movable element 2 is attracted to a magnetic pole, by applying the force Fl represented by the equation (5) to the movable element 2.

If the equation (4) is rearranged by substituting $$\phi_i=1,\ \phi=\alpha\phi_i=\alpha,\ \phi_b=\beta\phi=\alpha,\beta,$$

the following equation will be provided.

$$Fe/Fp = -\alpha^2 + 2\alpha(\alpha,\beta - 1) \quad (6)$$

This equation (6) is represented by graphs shown in FIG. 8 wherein the variation of Fe/Fb is represented by parameters $\alpha$ and $\beta$. That is, if condition $\phi_b > 0.5\ \phi$ is predetermined regardless of the position of movable element, the movable element is attracted to the $\phi_a$ side pole and stably held at the position when electric current is being flowed through the coil 4. While the movable element 2 is attracted to the $\phi_b$ side pole and stably held at the position when the coil 4 is free from electric current.

Additionally, according to the equation (6), FIG. 8 represents that the latching type electromagnetic actuator according to the present invention can generate attractive force several times greater than the conventional one by energizing the coils at the same ampere turn, when the electromagnetic actuator according to the present invention is so arranged as to determine the value of $\beta$; i.e., the number of $\phi_b/\phi$, be close to 0.5 and at largest 1. The permanent magnet 4 having magnetomotive force greater than the ampere turn is arranged in the present invention. Thus, the present invention can provide the electromagnetic actuator improved savings in electric power.

To accomplish the above object, the electromagnetic actuator according to the present invention mainly comprises a magnetic circuit containing a combination of stationary elements and movable elements, wherein a permanent magnet is so arranged that the magnetomotive force of the permanent magnet is inserted in parallel to the magnetomotive force of electromagnet in the magnetic circuit so as to actuate under monostable condition.

According to the above constitution, the present invention can provide the electromagnetic actuator having a simple and hardy structure and capable of operating with high sensitivity and at high speed.

PREFERRED EMBODIMENT OF THE PRESENT INVENTION

Hereinbelow, the present invention will be explained in detail according to the embodiments in conjunction with the drawings.

Figure 2A:
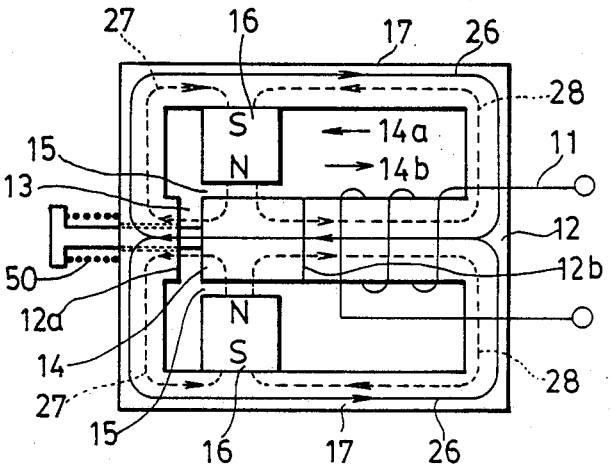
FIGS. 2(*a*) and (*b*) are schematic illustrations showing a first embodiment of the present invention.
Figure 2B:
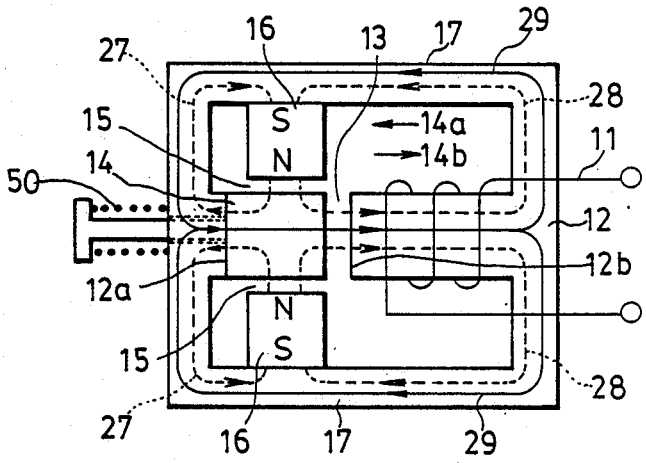

FIGS. 2(*a*) and (*b*) show a first embodiment of the present invention, wherein the electromagnetic actuator comprises a stationary element 12 as a magnetic circuit having a space energized by a coil 11; a movable element 14 made of a magnetic material which is inserted between pole faces 12*a* and 12*b* of the stationary element 12 through a first gap 13, the movable element 14 can be mechanically moved in the direction represented by the arrow 14*a* or 14*b* meeting with both the pole faces 12*a* and 12*b* at right angle; and a permanent magnet 16 fixed to a yoke 17 of the stationary element 12, the pole faces of the same polarity of the permanent magnet 16 are faced to the side surface of the movable element 14 through a small second gap 15.

An operation on this embodiment will be explained below. As shown in FIG. 2(*a*), when the movable element 14 is contacted to the pole face 12*b* of the stationary element 12, the movable element 14 is subjected to the magnetic attractive force towards the pole face 12*b* due to the magnetic flux 27,28 of the permanent magnet 16.

Under this condition, when an electric current in a pulse series is flowed through the coil 11 in the positive direction so as to generate the magnetic pole of N-polarity at the pole face 12*b* and the magnetic pole of S-polarity at the pole face 12*a*, magnetic flux 26 is generated. The magnetic flux 26 and the magnetic flux 27, 28 of the permanent magnet 16 will be concentrated to the first gap 13 so that the movable element 14 will be moved with a snap into the state shown in FIG. 2(*b*). After intercepting the current in a pulse series flowed in the positive direction, the movable element 14 can be held in the contacting state with the pole face 12*a* due to the magnetic flux 27,28 of the permanent magnet 16.

Under the condition shown in FIG. 2(*b*), when the electric current in a pulse series is flowed through the coil 11 in the reverse direction of the above so as to generate the magnetic pole of N-polarity at the pole face 12*a* and the magnetic pole of S-polarity at the pole face 12*b*, magnetic flux 29 is generated. The magnetic flux 29 and the magnetic flux 27,28 of the permanent 16 will be concentrated to the first gap 13, so that the movable element 14 is returned to the condition shown in FIG. 2(*a*).

Figure 3A:
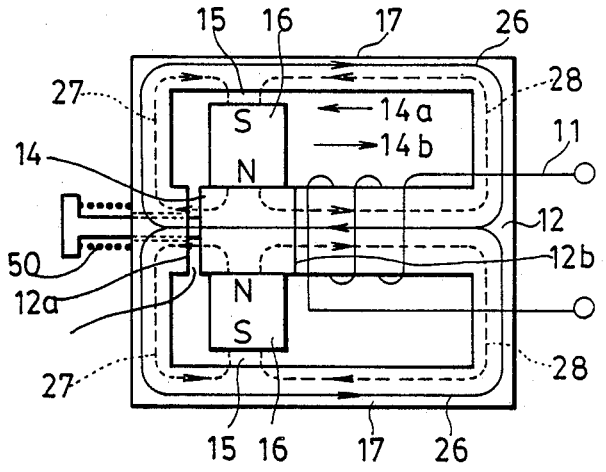
FIGS. 3(*a*) and (*b*) are schematic illustrations showing a second embodiment of the present invention.
Figure 3B:
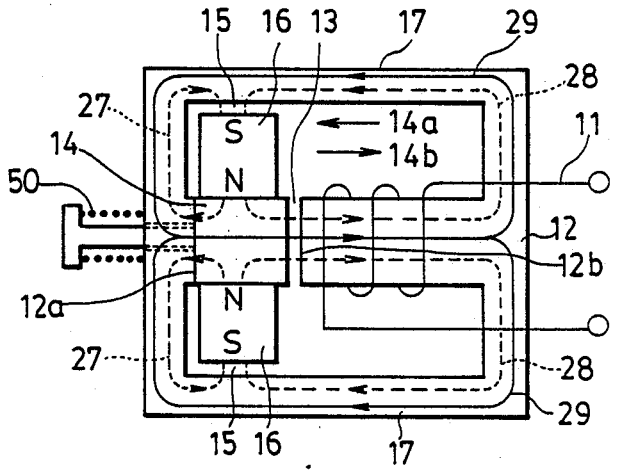

FIGS. 3(*a*) and (*b*) show a second embodiment of the present invention, wherein a permanent magnet 16 is so fixed onto the side surface of a movable element 14 as to form a small second gap 15 between a yoke 17 and the permanent magnet 16.

An operation of this embodiment is carried out in the same manner as the first embodiment shown in FIGS. 2(*a*) and (*b*).

Figure 4A:
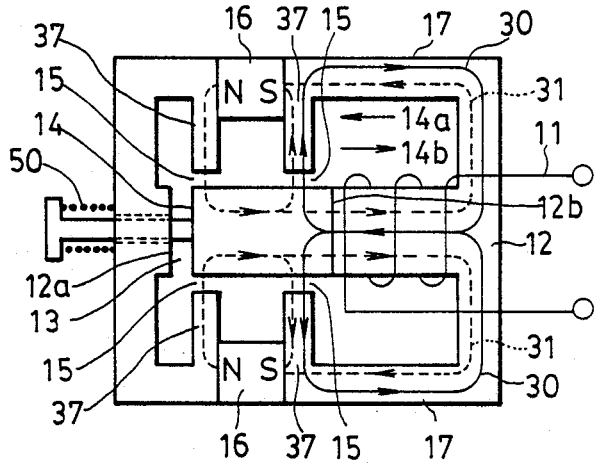
FIGS. 4(*a*) and (*b*) are schematic illustrations of a third embodiment of the present invention.
Figure 4B:
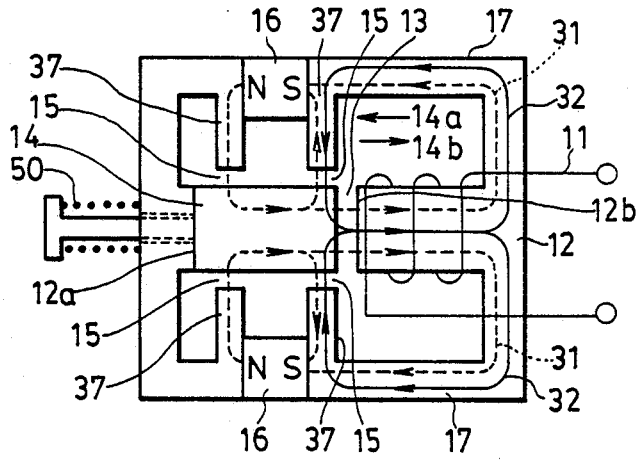

FIG. 4 shows a third embodiment of the present invention, wherein a movable element 14 capable of mechanically moving in the direction meeting to both pole faces 12*a* and 12*b* of a stationary element 12 at right angle is inserted between a space energized by a coil 11 and pole faces 12*a* and 12*b* through a first gap 13, a permanent magnet 16 is connected to the stationary element 12 in series, and contact element 37 is fixedly connected to both pole faces of the permanent magnet 16 so as to face to the side surfaces of the movable element 14 meeting to the pole face 12*b* at right angle through a second gap 15.

As shown in FIG. 4(*a*), when the movable element 14 contacts to the pole face 12*b* and faces to the pole face 12*a* through the first gap 13, the movable element 14 is magnetically attracted to the pole face 12*b* owing to the magnetic flux 31 caused by the permanent magnet 16.

Under this condition, when an electric current in a pulse series is flowed through the coil 11 in the positive direction so as to form N-polarity at the pole face 12*b* and S-polarity at the contact element 37 connected to the S-pole face of the permanent magnet 16, magnetic flux 30 is generated, the repulsion force caused by the magnetic flux 30 and magnetic flux 31 of the permanent magnet 16 will be generated at the pole face 12*b* so that the movable element 14 will be moved with a snap towards and attracted to the pole face 12*a* as shown in FIG. 4(*b*). After intercepting the current in a pulse series flowing in the positive direction, it is possible to maintain the attracted state of the movable element 14 to the pole face 12*a* owing to the magnetic flux 31 of the permanent magnet 16.

Under the condition shown in FIG. 4(*b*), when an electric current in a pulse series is flowed through the coil 11 in the reverse direction of the above so as to form S-polarity at the pole face 12*b* and N-polarity at the contact element 37, magnetic flux 32 is generated. So the magnetic flux 32 and the magnetic flux 31 of the permanent magnet 16 will be concentrated to the first gap 13 adjacent to the pole face 12*b* so that the movable element 14 will be returned to the condition shown in FIG. 4(*a*) and thus attracted to the pole face 12*b* of the stationary element 12.

Figure 5A:
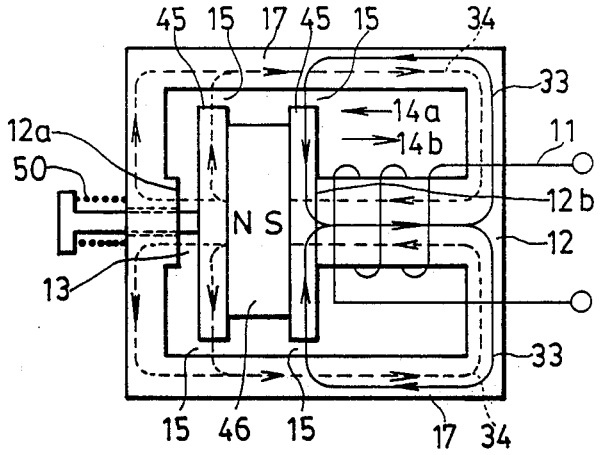
FIGS. 5(*a*) and (*b*) are schematic illustrations showing a fourth embodiment of the present invention.
Figure 5B:
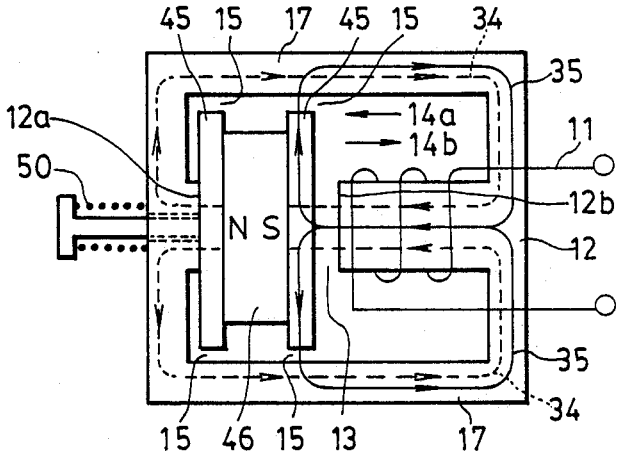
Figure 6:
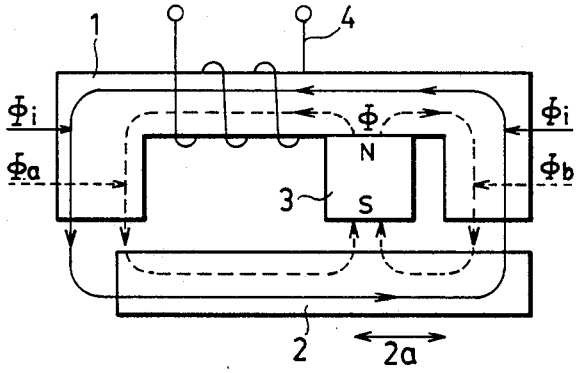
FIG. 6 is a schematic illustration showing a basic model of an electromagnetic actuator according to the present invention.
Figure 7:
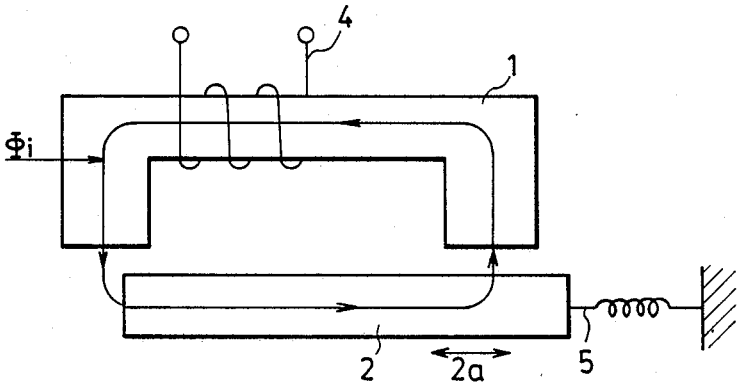
FIG. 7 is a schematic illustration showing a basic model of a conventional electromagnetic actuator.
Figure 8:
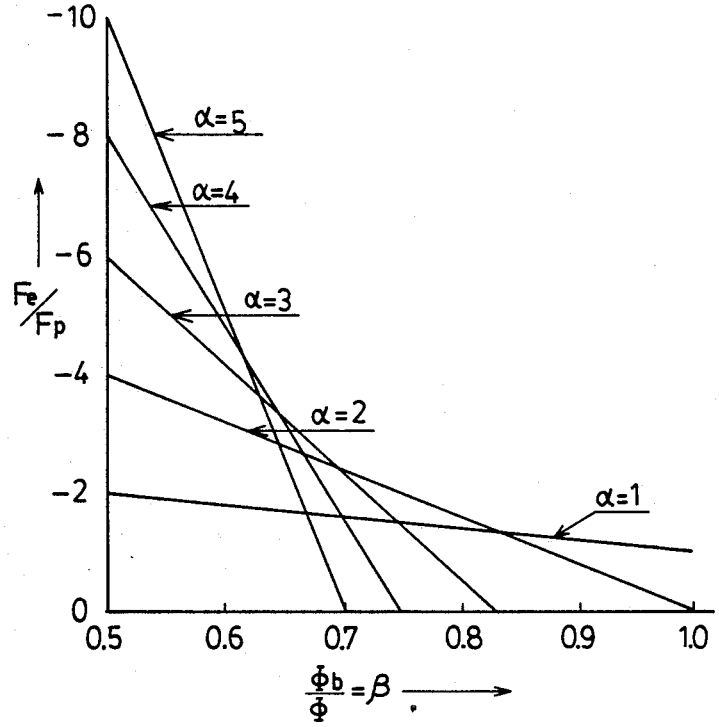
FIG. 8 is a graph representation showing the relation between magnetic flux and actuating force according to the device shown in FIG. 6.

FIG. 5 shows a fourth embodiment of the present invention wherein a pair of magnetic pole segments 45, 45 is arranged at both sides of a movable element 46 made of a permanent magnet instead of the permanent magnet 16 in the third embodiment shown in FIG. 4. An operation of this embodiment will be conducted according to magnetic flux 34 caused by the movable element 46 (made of permanent magnet) and magnetic flow 33, 35 caused by the flow of the electric current through the coil 11 in the same manner as the above embodiment shown in FIG. 4.

According to the present invention, the actuator is carried out in a monostable operation by employing a mechanical bias force; for example by means of a spring 50, which is a predetermined value smaller than the attractive force of the permanent magnet and applied in the counter direction of the permanent magnet so as to overlap the bias force with the relative movement between the stationary element and the moveable element.

As given explanation above, since the embodiment according to the present invention is so designed as to reduce the ampere turn of the coil as possible which supplies operation energy, the insertion of the powerful permanent magnet can result in the following extremely superior effects.

Figure 1A:
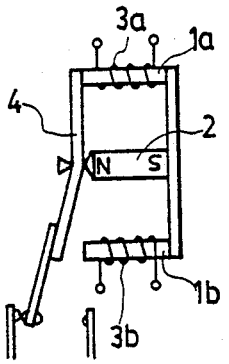
FIGS. 1(*a*) and (*b*) are schematic illustrations showing a conventional electromagnetic actuator.
Figure 1B:
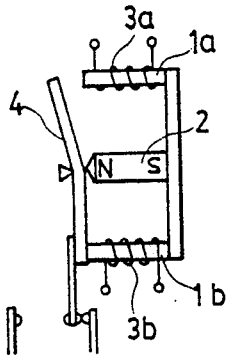

(1) In the operation of the present embodiment, the magnetic flux of energizing current and that of the permanent magnet always act on each other in only the inside of the soft magnetic material and thus the magnetomotive force caused by flowing an electric current through the coil does not directly act with that of the permanent magnet having a great coercive force as different from the conventional device shown in FIG. 1. Therefore, it is possible to reduce extremely the required ampere turn for energizing so that two different operation parameters for mechanical strength and mechanical position can be controlled by a minute electric current in a pulse series.

According to an experimental result, the movable element applied with the attractive force of 500 g could be moved in the reverse direction for a stroke of 2 mm with a thrust of 1 kg by supplying the extremely minute operation energy such as an electric current of 6 V, 0.5 A in a pulse series of several ten m/sec. On the other hand, conventionally used device requires a three wires type for a control cable in addition to the operation electric power of about 30 W for a stroke of 2 mm with a thrust of 1 kg.

(2) The embodiment of the present invention can be achieved by using a coil which can be operated by a two-wire type control cable while the conventional device shown in FIG. 1 requires two coils and a three-wire type control cable. Thus, the present invention can provide a compact, light and low cost device.

(3) The device according to the present invention can be operated by a minute electric current in a pulse series so that it is possible to reduce the cost of wiring equipment for a long distance remote operation.

(4) Since the device according to the present invention can be operated by a small energy such as a low voltage and a minute current, it is possible to use this device for an essential safety and exploding prevention device in a factory or mine, and to use a solar cell as an operation power source of this device.

Availability for Industry

As explained above, the present invention be effectively utilized for an electromagnetic valve, electromagnetic piston, electromagnetic locking device, switch operating mechanism, essential safety and exploding prevention device, abnormal retracting mechanism, or various industrial and private usage.

What is claimed is:

1. An electromagnetic actuator comprising a magnetic circuit consisting of a stationary element and a movable element, and electromagnetic means with a permanent magnet inserted in the magnetic circuit, the permanent magnet being mounted so that the magnetomotive force of the permanent magnet is parallel to that of said electromagnetic means; and the movable element is held within a space in the stationary element so that it can be actuated under monostable condition, characterized in that said electromagnetic means comprises a single electromagnetic coil (11) defining two pole faces (12*a*, 12*b*) so that the movable element contacts one or the other pole face, said permanent magnet (16) is fixed to the stationary element in series and contact elements (37) are mounted in contact with both pole faces of the permanent magnet (16) so as to force the side surfaces of the movable element (14) at right angles through the second gap (15).

2. An electromagnetic actuator comprising a magnetic circuit consisting of a stationary element and a movable element, and electromagnetic means with a permanent magnet inserted in the magnetic circuit, the permanent magnet being mounted so that the magnetomotive force of the permanent magnet is parallel to that of said electromagnetic means; and the movable element is held within a space in the stationary element so that it can be actuated under monostable condition, characterized in that said electromagnetic means comprises a single electromagnetic coil (11) defining two pole faces (12*a*, 12*b*) so that the movable element contacts one or the other pole face, the stationary element (12) is wound around with the electromagnetic coil (11) and formed into the magnetic circuit containing said space; and the movable element is composed of the permanent magnet (46) and two magnetic segments (45), each magnetic segment being fixed to each pole face of the permanent magnet, and the movable element is arranged in the space of the magnetic circuit so that the magnet segments face a yoke (17) of the stationary element through a second gap (15) so as to move alternatively between two positions shortly connecting the magnetomotive force of the permanent magnet.

* * * * *